US007591917B2

(12) United States Patent
Strezov et al.

(10) Patent No.: US 7,591,917 B2
(45) Date of Patent: Sep. 22, 2009

(54) METHOD OF PRODUCING STEEL STRIP

(75) Inventors: Lazar Strezov, Adamstown Heights (AU); Kannappar Mukunthan, Rankin Park (AU); Walter N. Blejde, Brownsburg, IN (US); Rama Ballav Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 10/401,300

(22) Filed: Mar. 27, 2003

(65) Prior Publication Data

US 2004/0003875 A1 Jan. 8, 2004

Related U.S. Application Data

(63) Continuation-in-part of application No. 09/967,105, filed on Sep. 28, 2001, now abandoned.

(30) Foreign Application Priority Data

Oct. 2, 2000 (AU) ..... PR0460

(51) Int. Cl.

| | |
|---|---|
| ***C21D 6/00*** | (2006.01) |
| ***B22D 11/16*** | (2006.01) |
| ***C22C 38/00*** | (2006.01) |
| ***B22D 11/12*** | (2006.01) |
| ***C21D 8/02*** | (2006.01) |

(52) U.S. Cl. ..... 148/661; 164/476; 164/477; 164/154.7; 164/455; 148/320; 148/541

(58) Field of Classification Search ..... 164/455, 164/476, 154.7; 148/320, 541, 661
See application file for complete search history.

(56) References Cited

U.S. PATENT DOCUMENTS 4,204,888 A 5/1980 Masumoto et al.

(Continued)

FOREIGN PATENT DOCUMENTS

DE 19832762 1/2000

(Continued)

OTHER PUBLICATIONS

Brick et al, Structure and Properties of Engineering Materials, "Iron and Steel Alloys:Low Carbon steels", pp. 254 to 255,4th edition, 1077.*

(Continued)

*Primary Examiner*—Roy King
*Assistant Examiner*—Jessee R. Roe
(74) *Attorney, Agent, or Firm*—Hahn Loeser & Parks LLP; Arland T. Stein

(57) ABSTRACT

Steel strips and methods for producing strip are provided. The method for producing steel strips comprises continuously casting low carbon, silicon/manganese killed or aluminum killed molten steel into a strip, the molten steel comprising a concentration of residuals of 2.0 equal to or less than about 2.0 wt % is selected with regard to the microstructure of the finished strip to provide a desired yield strength, where the residuals are selected in desired amounts from the group consisting of copper, nickel, chromium, molybdenum and tin, and cooling the strip to transform the strip from austenite to ferrite in a desired temperature range. Cast steel with improved yield strength properties is produced by such method.

21 Claims, 4 Drawing Sheets

U.S. PATENT DOCUMENTS

| | | | | | |
|---|---|---|---|---|---|
| 5,031,688 | A | * | 7/1991 | Burgo et al. | 164/452 |
| 5,357,443 | A | | 10/1994 | Watanbe et al. | |
| 5,567,250 | A | * | 10/1996 | Akamatsu et al. | 148/320 |
| 5,588,982 | A | * | 12/1996 | Hendrix | 75/10.5 |
| 5,662,748 | A | | 9/1997 | Mizoguchi et al. | |
| 5,727,127 | A | | 3/1998 | Schulze et al. | |
| 6,062,055 | A | | 5/2000 | Bobig et al. | |
| 6,085,183 | A | | 7/2000 | Horn et al. | |
| 6,581,672 | B2 | | 6/2003 | Strezov et al. | |

FOREIGN PATENT DOCUMENTS

| | | | |
|---|---|---|---|
| EP | 0541825 | | 5/1993 |
| EP | 0 641 867 | A1 | 3/1995 |
| EP | 0 706 845 | A1 | 4/1996 |
| EP | 0 707 908 | A1 | 4/1996 |
| EP | 0 969 112 | * | 1/2000 |
| GB | 2334464 | | 8/1999 |
| JP | 03-274231 | | 12/1991 |
| JP | 5-302147 | | 11/1993 |
| JP | 7310142 | | 11/1995 |
| JP | 08-290242 | | 5/1996 |
| JP | 10235540 | | 9/1998 |
| JP | 11057962 | | 3/1999 |
| RU | 2095461 | | 11/1997 |
| WO | 95/13155 | | 5/1995 |
| WO | 98/26882 | | 6/1998 |
| WO | WO 98/57767 | | 12/1998 |
| WO | 00/42228 | | 7/2000 |
| WO | 01/21844 | | 3/2001 |

OTHER PUBLICATIONS

K. Sachs, "Residuals in engineering steels," Metals Technology, p. 33-37, (Jan. 1979).

* cited by examiner

METHOD OF PRODUCING STEEL STRIP

This application is a continuation-in-part of U.S. patent application Ser. No. 09/967,105 filed Sep. 28, 2001, now abandoned which claims priority to Australian Provisional Patent Application No. PRO460, filed Oct. 2, 2000.

BACKGROUND AND SUMMARY OF THE INVENTION

The present invention relates to a method of producing steel strip and the cast strip produced according to the method. In particular, the present invention relates to producing steel strip in a continuous strip caster. The term "strip" as used in the specification is to be understood to mean a product of 5 mm thickness or less.

The applicants have carried out extensive research and development work in the field of casting steel strip in a continuous strip caster in the form of a twin roll caster.

In general terms, casting steel strip continuously in a twin roll caster involves introducing molten steel between a pair of contra-rotated horizontal casting rolls which are internally water cooled so that metal shells solidify on the moving roll surfaces and are brought together at the nip between the rolls to produce a solidified strip delivered downwardly from the nip, the term "nip" being used to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed. The casting of steel strip in twin roll casters of this kind is for example described in U.S. Pat. Nos. 5,184,668, 5,277,243 and 5,934,359.

We have found that the concentration of residuals in the steel composition can effect the finished microstructure, and in turn affect yield strength and other mechanical properties of cast strip. In particular, higher concentrations of residuals make it possible to use lower cooling rates to transform the strip from austenite to ferrite in a temperature range between about 850° C. and 400° C. to produce microstructures in the cast strip that provide high yield strengths. It is understood that the transformation temperature range may be within the range between about 850° C. and 400° C. and not necessarily that entire temperature range. The precise transformation temperature range will vary with the chemistry of the steel composition and processing characteristics.

There is provided a method of producing steel strip which includes the steps of:

(a) continuously casting molten low carbon steel, silicon/manganese killed steel or aluminum killed steel, as defined below, into a strip including austenite grains, said molten steel comprising a concentration of residuals in the steel composition selected with regard to the microstructure of the strip that is required to provide desired mechanical properties, said residuals selected from the group consisting of copper, nickel, chromium, molybdenum and tin where the residuals are selected from the group in the amounts of more than 0.15 wt % copper, more than 0.08 wt % nickel, more than 0.08 wt % chromium, more than 0.03 wt % molybdenum and more than 0.015 wt % tin; and (b) cooling the cast strip to transform the austenite grains in the strip to ferrite in a temperature range between about 850° C. and 400° C.

The continuous caster may be a twin roll caster. The term "residuals" covers levels of elements of copper, tin, nickel, chromium, and molybdenum that are included in relatively small amounts equal to or less than about 2.0%, and are usually as a consequence of standard steel making as occurs in an electric arc furnace and/or ladle metallurgy furnace. The residuals are the result of purposeful additions through directly adding to the molten melt of a source or sources of the desired residuals in the electric arc furnace and/or ladle metallurgy furnace in the following amounts: more than 0.15% copper, more than 0.08% nickel, more than 0.08% chromium, more than 0.03% molybdenum and more than 0.015% tin. These percentages are all by weight percent, and are often abbreviated as "wt %". The residuals in these amounts, which are greater than the weight percent of these elements found as impurities in typical steels, need not all be added to the molten steel to obtain the desired microstructure and resulting mechanical. Rather, the residual or residuals are selected from the group described to impart to the steel the desired microstructure and mechanical properties to the steel being made. In addition, in the case of low carbon steel, as defined below, where copper and tin are both used as residuals, the amount of copper plus tin must be $\geqq 1.15\%$.

Alternatively, the residuals may be purposely added through the mix of scrap steel used to produce the molten melt in an electric arc furnace. Pig iron or another source of relatively high purity iron is typically added to the melted scrap in an electric arc furnace to dilute the amounts of copper, nickel, chromium, molybdenum, tin, and other impurities, found in the scrap when melted. The levels of these residuals in the melted scrap is the result of the mixture and amounts of the elements in the scrap. The purposeful addition of the residuals for the present invention can therefore be through the selection of scrap with higher levels of one or more of the residual elements, and then adjusting the amount of pig iron, as for example by purposefully adding to the melt lesser amounts of pig iron, or no pig iron, to achieve the desired levels of the selected residual elements to achieve the desired microstructure and mechanical properties in the molten steel. For this reason, cheaper sources of scrap and lesser amounts of relatively expensive pig iron can be used to produce steels with particular microstructures and mechanical properties if desired. Again, in the case of low carbon steel, as defined below, where copper and tin are both used as residuals, the amount of copper plus tin must be $\geqq 1.15\%$.

These residuals may be up to about 2.0 wt % where harder cast steel strip is desired with yield strengths up to and in excess of 700 MPa. This weight percent is the total weight percent in the steel strip including the residuals from scrap steel and steel processing. In some embodiments, the total amount of the residuals may be 1.2 wt % or less. It should be noted that other residual elements, other than copper, nickel, chromium, molybdenum and tin, may be present as impurities in the steel, mostly from iron scrap, and can affect the microstructure and mechanical properties of the steel, but these other impurities are not purposefully controlled to achieve the desired microstructure and mechanical properties in the present invention.

In some embodiments, the cast strip produced in step (a) may have a thickness of no more than 2 mm.

In some embodiments, the cast strip produced in step (a) may include austenite grains that are columnar.

The steel may be low carbon steel, silicon/manganese killed steel or aluminum killed steel. The term "low carbon steel" is understood to be mean steel of the following composition, in wt %, that is not silicon/manganese killed steel or aluminum killed steel:

| | |
|---|---|
| Carbon: | 0.02-0.08 |
| Manganese: | 1.0 or less; |
| Silicon: | 0.5 or less; |
| residuals: | 2.0 or less; and |
| Fe: | balance. |

The steel may be silicon/manganese killed, which has the following composition by weight:

| | |
|---|---|
| Carbon: | 0.02-0.08% |
| Manganese: | 0.30-0.80% |
| Silicon: | 0.10-0.40% |
| Sulfur: | 0.002-0.05% |
| Aluminum: | less than 0.01% |
| residuals: | 2.0 or less; and |
| Fe: | balance. |

The steel may be aluminum killed, which has the following composition by weight:

| | |
|---|---|
| Carbon: | 0.02-0.08% |
| Manganese: | 0.40% max |
| Silicon: | 0.05% max |
| Sulfur: | 0.002-0.05% |
| Aluminum: | 0.05% max |
| residuals: | 2.0 or less; and |
| Fe: | balance. |

The aluminum killed steel may be calcium treated. The method may further include the step of inline hot rolling.

Step (b) may include cooling the strip to transform the strip from the austenite to ferrite at a selected cooling rate of at least about 0.01° C./sec, and usually at least 0.1° C./sec, to produce a microstructure that provides required yield strength properties of the cast strip, the microstructure being selected from a group that includes microstructures that are:

(i) predominantly polygonal ferrite;

(ii) a mixture of polygonal ferrite and low temperature transformation products; and/or (iii) predominantly low temperature transformation products.

It is understood that most embodiments of the present invention will have microstructures of types (ii) and/or (iii).

The term "low temperature transformation products" includes Widmanstatten ferrite, acicular ferrite, bainite, and martensite.

BRIEF DESCRIPTION OF THE DRAWINGS

In order that the invention may be more fully explained, an example will be described with reference to the accompanying drawings, in which.

DETAILED DESCRIPTION OF THE INVENTION

The following description is in the context of continuous casting steel strip using a twin roll caster. The present invention is not limited to the use of twin roll casters and extends to other types of continuous strip casters.

Figure 1:
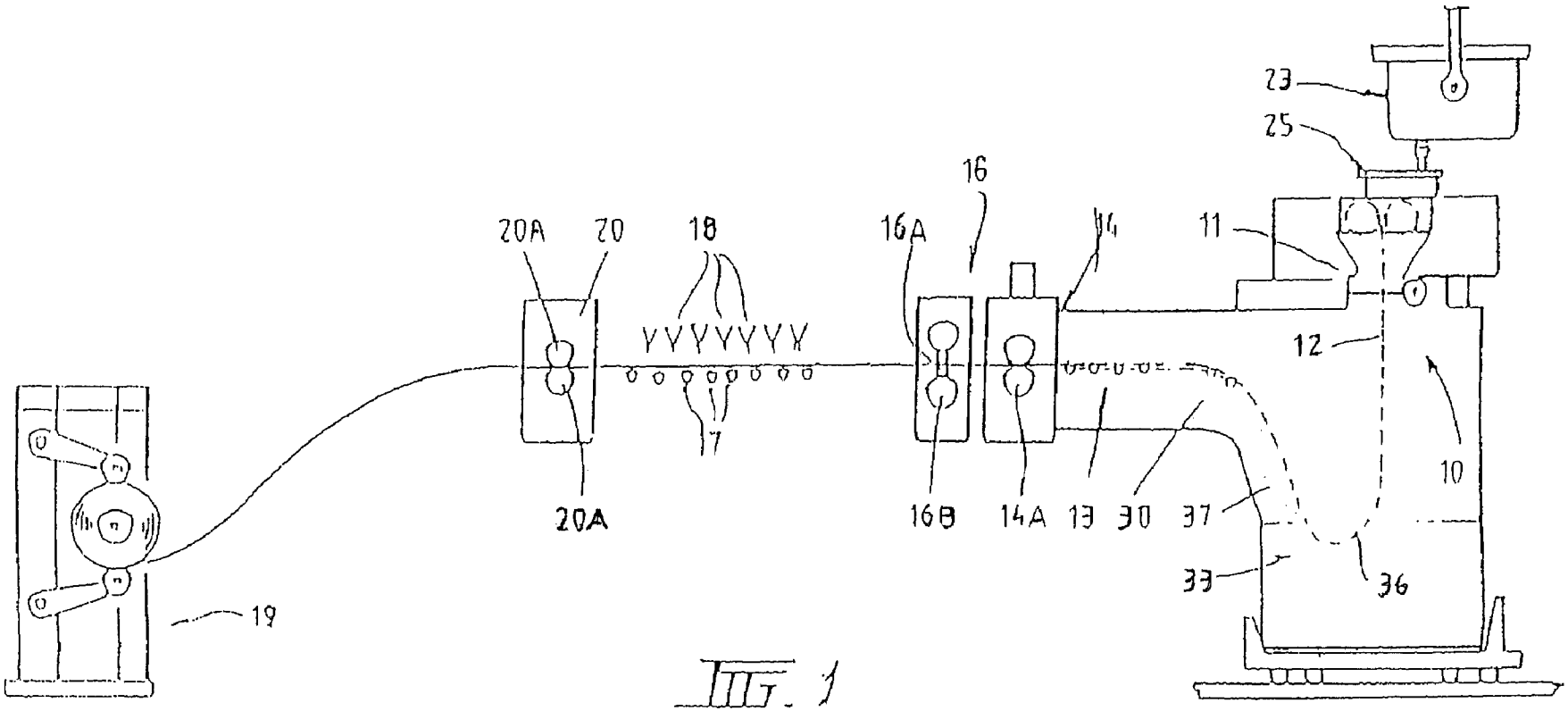
FIG. 1 depicts or illustrates a strip casting installation incorporating an in-line hot rolling mill and coiler.
Figure 2:
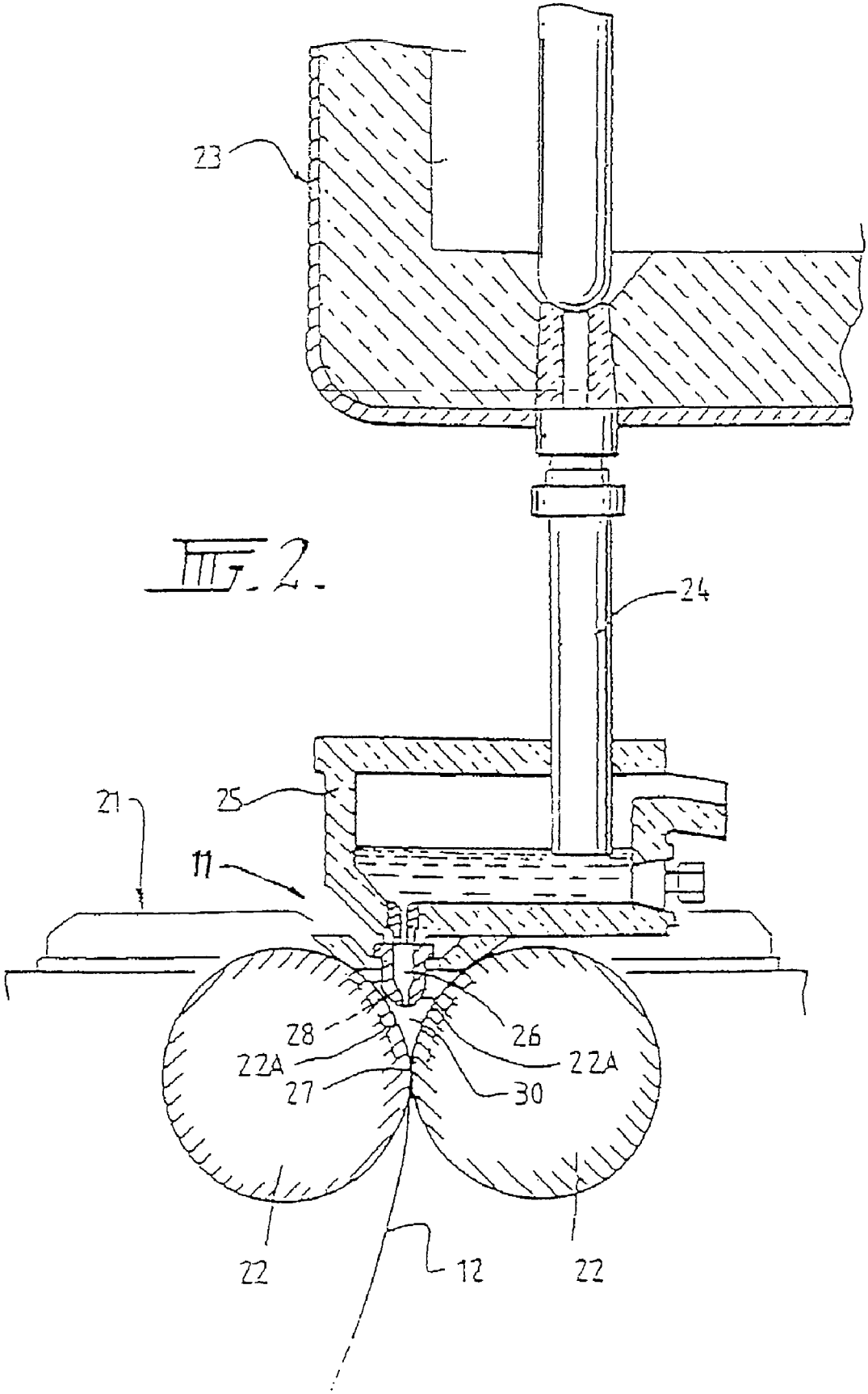
FIG. 2 illustrates details of the illustrated twin roll strip caster of FIG. 1.
Figure 3:
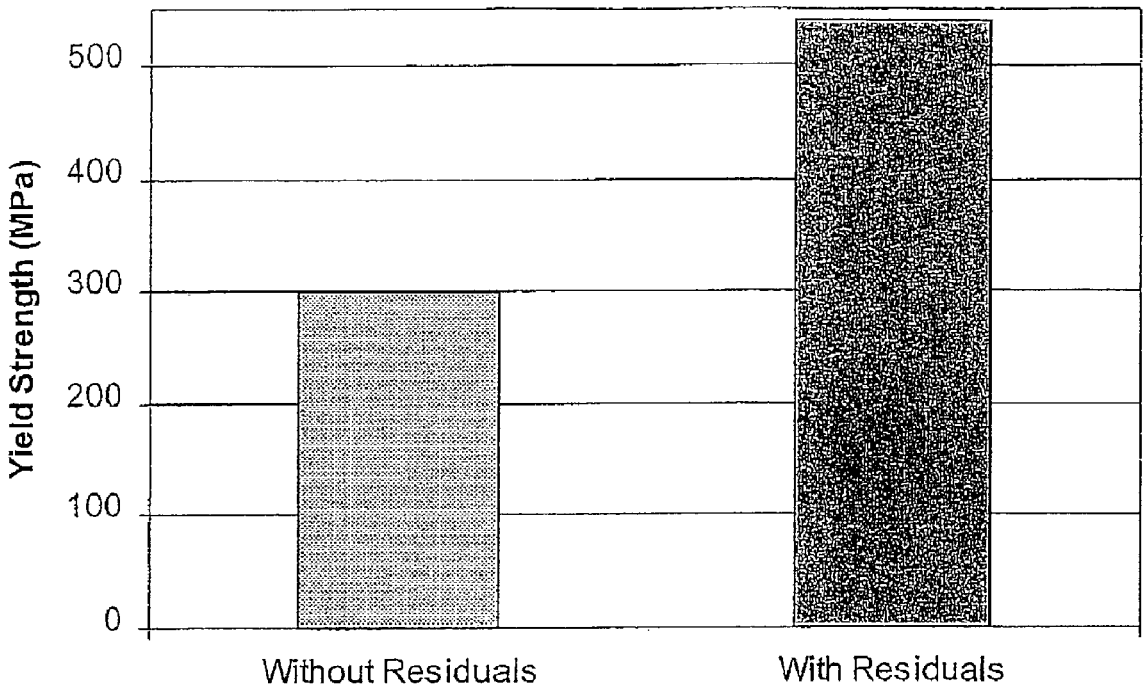
FIG. 3 illustrates the effect of residuals on yield strength of cast strip.

FIG. 1 illustrates successive parts of a production line whereby steel strip can be produced in accordance with the present invention. FIGS. 1 and 2 illustrate a twin roll caster denoted generally as 11 which produces a cast steel strip 12 that passes in a transit path across a guide table 13 to a pinch roll stand 14 comprising pinch rolls 14A. Immediately after exiting the inch roll stand 14, the strip passes into a hot rolling mill 16 comprising a pair of reduction rolls 16A and backing rolls 16B in which it is hot rolled to reduce its thickness. The rolled strip passes onto a run-out table 17 on which it may be force cooled by water jets 18 and through a pinch roll stand 20 comprising a pair of pinch rolls 20A, and thence to a coiler 19.

As shown in FIG. 2, twin roll caster 11 comprises a main machine flame 21 which supports a pair of parallel casting rolls 22 having a casting surfaces 22A. Molten metal is supplied during a casting operation from a ladle (not shown) to a tundish 23, through a refractory shroud 24 to a distributor 25 and thence through a metal delivery nozzle 26 into the nip 27 between the casting rolls 22. Molten metal thus delivered to the nip 27 forms a pool 30 above the nip and this pool is confined at the ends of the rolls by a pair of side closure dams or plates 28 which are applied to the ends of the rolls by a pair of thrusters (not shown) comprising hydraulic cylinder units connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roll surfaces and are brought together at the nip 27 between them to produce the solidified strip 12 which is delivered downwardly from the nip between the rolls.

The twin roll caster may be of the kind which is illustrated and described in some detail in U.S. Pat. Nos. 5,184,668 and 5,277,243 or U.S. Pat. No. 5,488,988 and reference may be made to those patents for appropriate constructional details which form no part of the present invention.

Typically, the strip passing from the twin roll caster will have a temperature of the order of about 1400° C. and the temperature of the strip presented to the hot rolling mill may be about 900-1100° C. The strip may have a width in the range of 0.9 m to 2.0 m and a thickness in the range of 0.7 mm to 2.0 mm. The strip speed may be in the order of 1.0 m/sec.

The cooling rate in transforming the strip from austenite to ferrite in a temperature range between about 850° C. and 400° C. is selected to be at least 0.01° C./sec, preferably at least 0.1° C./sec, and may be in excess of 100° C./sec. With such cooling rates for low carbon steel it is possible to produce cast strip having microstructure including:

(i) predominantly polygonal ferrite;

(ii) a mixture of polygonal ferrite and low temperature transformation products, such as a acicular ferrite, Widmanstatten ferrite, and bainite; and/or (iii) predominantly low temperature transformation products.

It is understood that most embodiments of the present invention will have microstructures of types (ii) and/or (iii).

In the case of low carbon steels, such a range of microstructures can produce yield strengths in excess of 450 MPa.

The concentration of residuals in the steel is selected having regard to the finished microstructure of the cast strip that is required to provide desired mechanical properties for the strip.

The present disclosure is based on experimental work that has found with a low carbon steel of about 0.05% C, 0.6% Mn, 0.3% Si, <0.006% Al, <0.009% S and <0.009% P and the presence of high amounts of residuals (0.2% Cr, 0.2% Ni, 0.2% Mo, 0.4% Cu, 0.2% Sn, for total residuals of 1.2%) has produced a strip with improved microstructure and resulting mechanical properties. The residuals can be added to the steel composition either by addition of one or more of the residuals, or by starting with scrap with higher levels of one or more of the residuals and adding less pig iron or other iron source to the scrap, or a combination of these addition routes. The experimental findings indicated that when strip cast with residuals was subjected to a standard cooling rate of 10-15° C./sec, the resultant finished microstructure was very different from that of the cast strip without residuals cooled at the same rate.

The observed microstructure of cooled cast strip with residuals was predominantly bainite with only a thin band of grain boundary ferrite appearing along the prior austenite grain boundaries, indicating a severely suppressed ferrite transformation caused by the presence of residuals. The mechanical properties of the resultant product are desirable, with typical values of 540 MPa yield strength, 650 MPa tensile strength and 155% total elongation. Such values could be achieved in the past by microalloying which added considerable cost to the production of the cast strip.

The effect of residuals was to enhance the proportion of low temperature transformation products (particularly the bainites) by lowering austenite to ferrite transformation temperatures and slowing the kinetics of polygonal ferrite formation.

Figure 4:
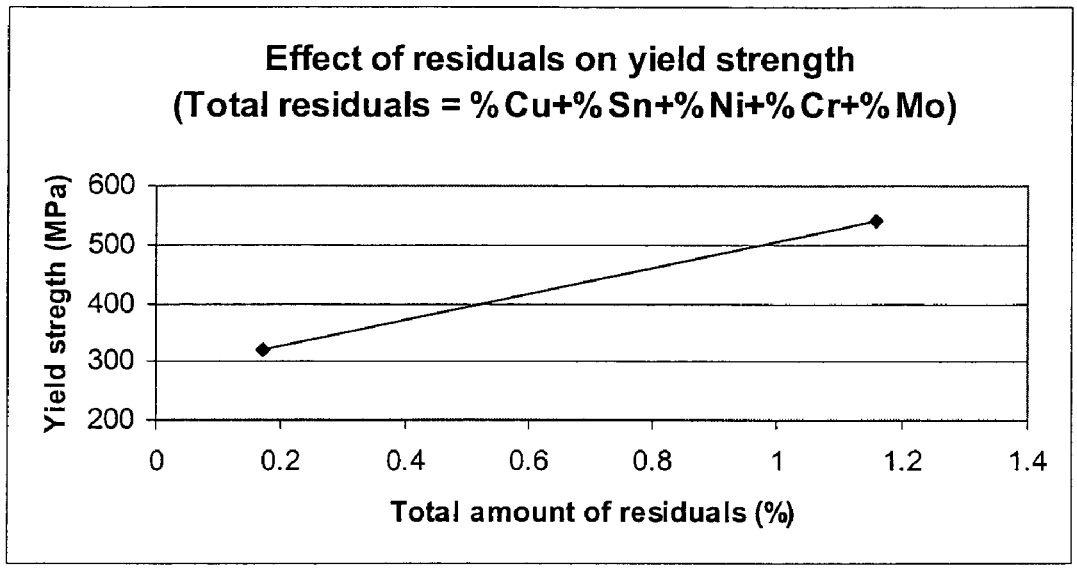
FIG. 4 illustrates the effect of residuals on the yield strength of the steel.

By contrast, the same low carbon steel with low residuals (0.07% Cu, 0.03% Ni, 0.05% Cr, 0.01% Mo and 0.01% Sn, for a total of 0.17%) was made. This steel has a yield strength of 320 MPa. The improvement provided by the present invention for the effects of total residuals on yield strength can therefore be illustrated in FIG. 4.

One, but not the only one, of the consequences of this invention is that an increase in the concentration of residuals effects a reduction in the cooling rate that is required to transform austenite to ferrite to form a desired microstructure to provide high yield strengths.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

The invention claimed is:

1. A method of producing low carbon steel strip comprising the steps of:

(a) continuously casting molten low carbon steel strip less than 5 mm thickness in a twin roll caster into austenite grains, said molten steel comprising a concentration of residuals of equal to or less than about 2.0 wt % selected with regard to the microstructure of the finished strip to provide a desired yield strength, said residuals selected from the group consisting of copper, nickel, chromium, molybdenum and tin where the residuals are selected from the group in the amounts of more than 0.15 wt % copper, more than 0.08 wt % nickel, more than 0.08 wt % chromium, more than 0.03 wt % molybdenum, more than 0.015 wt % tin, where if copper and tin are selected then an amount equal or more than 1.15 wt % copper plus tin is selected; and (b) cooling to form the cast strip as cast, without reheating, to transform austenite grains in the strip to ferrite in a temperature range between 850° C. and 400° C. at a selected cooling rate of at least 0.01° C./sec to produce a microstructure that provides a required yield strength of the cast strip, the microstructure being selected from the group consisting of:

(i) predominantly polygonal ferrite; and/or (ii) a mixture of polygonal ferrite and low temperature transformation products.

2. The method of claim 1 wherein the residuals are added by the purposeful addition of a source or sources for the residual to the molten metal in an electric arc furnace or ladle metallurgy furnace.

3. The method of claim 1 wherein the residuals are added by purposefully selecting scrap with high levels of the resulted residuals and adjusting the amount of pig iron added to the scrap in an electric arc furnace to form the molten metal for casting.

4. The method of claim 1 wherein the total amount of the residuals is 1.2 wt % or less.

5. The method of claim 1 wherein the cast strip produced in step (a) comprises austenite grains that are columnar.

6. The method of claim 1 further comprising the step of in-line hot rolling the cast strip.

7. The method of claim 1 wherein the cooling rate is selected so that the microstructure is a mixture of polygonal ferrite and low temperature transformation products.

8. A method of producing silicon/manganese killed steel strip comprising the steps of:

(a) continuously casting molten silicon/manganese killed steel in a twin roll caster into a strip less than 5 mm thickness forming into austenite grains, said molten steel comprising a concentration of residuals of equal to or less than about 2.0 wt % selected with regard to the microstructure of the finished strip to provide a desired yield strength, said residuals selected from the group consisting of copper, nickel, chromium, molybdenum and tin where the residuals are selected from the group in the amounts of more than 0.15 wt % copper, more than 0.08 wt % nickel, more than 0.08 wt % chromium, more than 0.03 wt % molybdenum, more than 0.015 wt % tin; and (b) cooling to form the cast strip as cast, without reheating, to transform austenite grains in the strip to ferrite in a temperature range between 850° C. and 400° C. at a selected cooling rate of at least 0.01° C./sec to produce a microstructure that provides a required yield strength of the cast strip, the microstructure being selected from the group consisting of:

(i) predominantly polygonal ferrite; and/or (ii) a mixture of polygonal ferrite and low temperature transformation products.

9. The method of claim 8 wherein the residuals are added by the purposeful addition of a source or sources for the residual to the molten metal in an electric arc furnace or ladle metallurgy furnace.

10. The method of claim 8 wherein the residuals are added by purposefully selecting scrap with high levels of the resulted residuals and adjusting the amount of pig iron added to the scrap in an electric arc furnace to form the molten metal for casting.

11. The method of claim 8 wherein the total amount of the residuals is 1.2 wt % or less.

12. The method of claim 8 wherein the cast strip produced in step (a) comprises austenite grains that are columnar.

13. The method of claim 8 further comprising the step of in-line hot rolling the cast strip.

14. The method of claim 8 wherein the cooling rate is selected so that the microstructure is a mixture of polygonal ferrite and low temperature transformation products.

15. A method of producing aluminum killed steel strip comprising the steps of:

(a) continuously casting molten aluminum killed steel in a twin roll caster into a strip less than 5 mm thickness forming into austenite grains, said molten steel comprising a concentration of residuals of equal to or less than about 2.0 wt % selected with regard to the microstructure of the finished strip to provide a desired yield strength, said residuals selected from the group consisting of copper, nickel, chromium, molybdenum and tin where the residuals are selected from the group in the amounts of more than 0.15 wt % copper, more than 0.08 wt % nickel, more than 0.08 wt % chromium, more than 0.03 wt % molybdenum, more than 0.015 wt % tin; and (b) cooling to form the cast strip as cast, without reheating, to transform austenite grains in the strip to ferrite in a temperature range between 850° C. and 400° C. at a selected cooling rate of at least 0.01° C./sec to produce a microstructure that provides a required yield strength of the cast strip, the microstructure being selected from the group consisting of:

(i) predominantly polygonal ferrite; and/or (ii) a mixture of polygonal ferrite and low temperature transformation products.

16. The method of claim 15 wherein the residuals are added by the purposeful addition of a source or sources for the residual to the molten metal in an electric arc furnace or ladle metallurgy furnace.

17. The method of claim 15 wherein the residuals are added by purposefully selecting scrap with high levels of the resulted residuals and adjusting the amount of pig iron added to the scrap in an electric arc furnace to form the molten metal for casting.

18. The method of claim 15 wherein the total amount of the residuals is 1.2 wt % or less.

19. The method of claim 15 wherein the cast strip produced in step (a) comprises austenite grains that are columnar.

20. The method of claim 15 further comprising the step of in-line hot rolling the cast strip.

21. The method of claim 15 wherein the cooling rate is selected so that the microstructure is a mixture of polygonal ferrite and low temperature transformation products.

* * * * *